US012077250B2

(12) United States Patent
Reinås et al.

(10) Patent No.: US 12,077,250 B2
(45) Date of Patent: Sep. 3, 2024

(54) MARINE SUCTION ANCHOR

(71) Applicant: EQUINOR ENERGY AS, Stavanger (NO)

(72) Inventors: Lorents Reinås, Stavanger (NO); Kjell Einar Ellingsen, Tananger (NO); Asle Eide, Sandnes (NO); Bjørgulf Haukelidsæter Eidesen, Stavanger (NO); Harald Sigurd Nesse, Sandnes (NO); Roger Vangsnes, Høvik (NO); Morten Sæther, Lillestrøm (NO)

(73) Assignee: EQUINOR ENERGY AS, Stavanger (NO)

( * ) Notice: Subject to any disclaimer, the term of this patent is extended or adjusted under 35 U.S.C. 154(b) by 280 days.

(21) Appl. No.: 16/644,222

(22) PCT Filed: Jan. 23, 2018

(86) PCT No.: PCT/NO2018/050015
§ 371 (c)(1),
(2) Date: Mar. 4, 2020

(87) PCT Pub. No.: WO2019/050410
PCT Pub. Date: Mar. 14, 2019

(65) Prior Publication Data

US 2020/0198735 A1 Jun. 25, 2020

(30) Foreign Application Priority Data

Sep. 7, 2017 (GB) ..... 1714402

(51) Int. Cl.
*B63B 21/00* (2006.01)
*B63B 21/27* (2006.01)
(Continued)

(52) U.S. Cl.
CPC ..... *B63B 21/27* (2013.01); *E02D 27/52* (2013.01); *E21B 33/035* (2013.01); *E02D 23/00* (2013.01)

(58) Field of Classification Search
CPC ..... B63B 21/27; E02D 27/52; E02D 23/00; E21B 33/035
(Continued)

(56) References Cited

U.S. PATENT DOCUMENTS 4,558,744 A 12/1985 Gibb
4,572,304 A * 2/1986 Mahar ..... B63B 21/27 175/203
(Continued)

FOREIGN PATENT DOCUMENTS

GB 2552065 1/2018
KR 10-2015-0052622 5/2015
(Continued)

OTHER PUBLICATIONS

International Search Report and Written Opinion of the International Searching Authority issued Mar. 16, 2018 in International (PCT) Application No. PCT/NO2018/050015.
(Continued)

*Primary Examiner* — Matthew Troutman
*Assistant Examiner* — Patrick F Lambe
(74) *Attorney, Agent, or Firm* — Wenderoth, Lind & Ponack, L.L.P.

(57) ABSTRACT

A suction anchor and method of installing the suction anchor. The suction anchor including a suction chamber bounded by: a circumferential outer wall; an upper wall; and an internal housing wall. The internal housing defining a passage for receiving wellhead components that may be secured to the suction anchor. The suction chamber has a minor upper portion and a major lower portion. The minor
(Continued)

upper portion having internal reinforcing members extending along the inside of the upper wall from the outer walls to the internal housing. The major portion is adapted to be embedded in a seabed and the minor portion is adapted to project from the seabed when the anchor is installed. The reinforcing members serve to reinforce the upper wall of the chamber against collapse and to rigidly support the internal housing to resist forces arising from bending moments applied to wellhead components received and secured therein.

19 Claims, 2 Drawing Sheets

(51) Int. Cl.
*E02D 27/52* (2006.01)
*E21B 33/035* (2006.01)
*E02D 23/00* (2006.01)

(58) Field of Classification Search
USPC ..... 114/296
See application file for complete search history.

(56) References Cited

U.S. PATENT DOCUMENTS

| | | | | |
|---|---|---|---|---|
| 6,692,194 | B2 | 2/2004 | Strand | |
| 10,221,539 | B2 * | 3/2019 | Mathis | E21B 41/0007 |
| 10,724,309 | B2 * | 7/2020 | Mathis | E21B 19/002 |
| 2003/0029620 | A1 * | 2/2003 | Strand | E21B 33/02 405/227 |
| 2008/0304915 | A1 * | 12/2008 | Bang | B23D 57/0084 405/224.1 |
| 2012/0003048 | A1 | 1/2012 | Hosoy et al. | |
| 2016/0333641 | A1 | 11/2016 | Ellison | |

FOREIGN PATENT DOCUMENTS

| | | |
|---|---|---|
| KR | 10-2017-0048832 | 5/2017 |
| WO | 01/65050 | 9/2001 |
| WO | 2010/068119 | 6/2010 |
| WO | 2013/167872 | 11/2013 |
| WO | 2015/054766 | 4/2015 |
| WO | 2015/118348 | 8/2015 |
| WO | 2017/091084 | 6/2017 |
| WO | 2017/179992 | 10/2017 |

OTHER PUBLICATIONS

Search Report form IPO issued Feb. 22, 2018 in corresponding GB Application No. 1714402.3.
Office Action issued Aug. 10, 2021 in corresponding GB Application No. 1714402.3.
Office Action issued Sep. 22, 2022 in corresponding Chinese Patent Application No. 201880069261.5, with English translation.
English Translation of a Preliminary Office Action issued Oct. 4, 2022 in corresponding Brazilian Application No. BR112020004514-4.
Second Office Action issued Jun. 6, 2022 in corresponding Chinese Patent Application No. 201880069261.5, with English Translation.
Danda et al., "Foundation Engineering", Shangahi Pujiang Education Press, Jan. 2013, pp. 143-145.

* cited by examiner

MARINE SUCTION ANCHOR

This invention relates to a marine suction anchor for use as the foundation and support of a subsea well, such as a hydrocarbon well. In particular, it relates to such a structure that provides integral support to a wellhead housing whereby bending moments applied to that housing, such as riser-induced loads, may be absorbed.

A suction anchor is a device that forms a closed volume with the sea bed (or whichever surface it is to be sucked into) and in which the pressure can be adjusted so that it can be moved relative to the seabed. This is achieved by reducing the pressure inside the suction anchor to be less than the external sea pressure at the depth at which the suction anchor is located so that the suction anchor is sucked/pushed into the sea bed by the pressure differential created. Conversely, if it is desired to uninstall the suction anchor, this may be achieved by increasing the pressure inside the suction anchor to be greater than the external sea pressure at the depth at which the suction anchor is located so that the suction anchor is forced out of the sea bed by the pressure differential created.

Suction anchors are increasingly being adopted as foundations for subsea wells, typically hydrocarbon wells. Once the suction anchor has been installed in the sea bed, a conductor—i.e. a pipe forming an outer casing for the well—is installed through the centre of the suction anchor into the sea bed, for example by piling or cementing it into an oversize hole. Once the conductor has been installed, the wellhead may be landed into the conductor such that it extends above the suction anchor, with a wellhead casing extending downwardly within the conductor.

Examples of known suction anchors of this type are disclosed in WO 01/65050 and WO 2010/068119. In each case, a central opening is provided in the upper surface of the anchor for receiving the conductor, wellhead, etc. Both of these documents also illustrate the provision of a central pipe depending from the central opening for receiving the conductor etc. WO 01/65050 in particular describes how this provides lateral support to the conductor, both during piling/installation and also to absorb forces and loads applied to it when it is later used as an anchoring point for the wellhead. It also discloses the provision of radial internal supporting walls extending nearly the full height of the anchor that serve to support the central pipe against both the outer wall and upper surface of the anchor.

Another known suction anchor is disclosed in WO 2013/167872, where it is illustrated with a high pressure wellhead installed. This is provided with an integral conductor, in place of the central pipe described above, for receiving a wellhead casing. Radially extending internal walls are provided within a domed upper surface of the anchor by way of reinforcements.

A typical subsea wellhead assembly comprises the subsea wellhead (i.e. high pressure wellhead housing) to which subsea riser system equipment, such as a blowout preventer—BOP—(which may comprise a lower stack and a lower marine riser package (LMRP)) and/or a Christmas tree (which may also be referred to as a subsea tree) may be connected. The subsea riser system equipment is connected (in a downwards direction) to the wellhead and is typically connected (in an upwards direction) to a riser that extends between this riser system equipment and a surface facility, such as a floating vessel. The riser typically provides a conduit for the drill string and drilling fluids between the subsea well and the surface facility.

It is important that the wellhead assembly's integrity is maintained so that structural failure and uncontrolled release of well fluids does not occur. As a result, it is desirable that forces that act on the assembly have as low risk as possible of damaging the assembly.

One source of such forces is the bending moment that may be applied to the wellhead by the swaying motion of the relatively massive BOP and other components located above the wellhead. This may lead to deformation of the wellhead and ultimately fatigue failure causing it to rupture.

As discussed above, it is known for suction anchors to be provided with internal structures that may serve to provide lateral support to the conductor and hence to the wellhead housing and/or casing received within it. WO 2016/085348, on the other hand, proposes the provision of a separate supporting frame that may be mounted on top of a wellhead foundation in order to transfer bending moment exerted on the wellhead to the foundation and into the ground. The frame comprises horizontal beams that extend radially from the wellhead and which are provided with downwardly extending feet at their circumferential ends. These in turn have abutments that rest on top of the foundation.

According to a first aspect of the invention there is provided a suction anchor comprising: a suction chamber bounded by: (i) a circumferential outer wall, (ii) an upper wall having a central opening, and (iii) the wall of an internal housing; the internal housing defining a passage in communication with the central opening for receiving wellhead components that may be secured to the suction anchor; the suction chamber having a minor upper portion and a major lower portion; the minor upper portion comprising internal reinforcing members extending along the inside of the upper wall from the outer walls to the internal housing; the major portion being adapted to be embedded in a seabed and the minor portion being adapted to project from the seabed when the anchor is installed; wherein the reinforcing members serve both to reinforce the upper wall of the chamber against collapse and to rigidly support the internal housing such that it may resist forces applied to it arising from bending moments applied to a wellhead component received and secured therein.

Thus, the suction anchor of the present invention is configured such that the reinforcements used to provide the necessary strength to the upper wall of the suction chamber also serve to transmit lateral forces applied to the wellhead to the suction anchor and thus to the seabed. As such, the wellhead may be protected against bending moments applied to it by components such as a BOP located above it without the need for additional components, such as a supporting frame, and in particular the need to install such components onto the suction anchor at the seabed.

The present invention renders the separate supporting frame superfluous because bending moment is effectively transferred to the reinforcing members, which constitute the structural support of the upper wall of the suction anchor and also assumes lateral and horizontal forces exerted on the wellhead. Thereby, both the structural design and the installation procedures are simplified. The present invention therefore provides a suction anchor that addresses at least some of the drawbacks found in the prior art.

It should be noted that the term "central" and similar terms used herein are not intended to refer to the precise geometrical centre of the suction anchor. Rather, the term is used to refer to the region at or towards the centre of the suction anchor that is surrounded by the suction chamber. Likewise, "circumferential wall" is not intended to refer only to circular structures, but to any wall defining the perimeter of a suction chamber; that perimeter may be circular or polygonal (regular or otherwise).

Since the major portion is that part which is adapted for being embedded in the sea bed when installed and the minor portion is adapted to project from the sea bed, the reinforcements being located only at the upper part of the suction chamber (i.e. in the minor portion thereof) do not obstruct the movement of the suction anchor into the seabed.

To facilitate its embedding into the seabed, the major portion may be substantially void of further internal components, and in particular, the reinforcements provided in the minor portion should not extend into the major portion. Indeed, preferably, the reinforcements themselves lie on the sea bed when the suction anchor is fully installed. However, it may be necessary to provide certain additional bracing members within the major portion to support other components provided beneath the internal housing.

The internal housing may be adapted to directly receive wellhead components (e.g. a wellhead housing). However, preferably the internal housing is a conductor housing receptacle adapted to receive a conductor housing. This has the advantage that standard wellhead components may then be mounted into the conductor housing in the conventional manner. Accordingly, the conductor housing receptacle preferably further comprises a conductor housing located therein and rigidly secured thereto, the conductor housing being adapted to receive a wellhead component.

In these arrangements, the conductor housing may be secured to the conductor housing receptacle by any convenient manner, e.g. by welding. However, it is preferred that the conductor housing is clamped into the conductor housing receptacle. For example, it may be supported at a lower part thereof by a support ring against which it may be clamped by a clamping ring.

The reinforcing members make take any suitable form and configuration that both provides sufficient resistance against collapse of the upper wall (i.e. implosion) and sufficient rigidity to the wall of the internal housing. One convenient arrangement is for the reinforcing members to extend radially from the wall of the internal housing to the outer wall—e.g. like spokes in a wheel. The reinforcement members themselves may, for example, be I-beams.

The suction anchor preferably further comprises a central (inner) pipe depending from the internal housing. This serves to bound the inner part of the major portion of the suction chamber. Thus, it may form a downward extension to the internal housing and/or a conductor housing located therein. As such, it may be adapted to receive a well casing depending from a wellhead secured in the internal housing. By means of this arrangement, it is not necessary for there to be a conductor extending below the conductor housing in the conventional manner. If necessary, the central pipe may be secured against lateral movement by means of one or more bracing members within the major portion, as mentioned above. Such components are to be distinguished from the reinforcements found in the minor portion. Preferably, such bracing members would be provided in the lower part of the major portion and hence distant from the reinforcements. They may extend from such a central pipe to the outer wall.

The suction anchor preferably further comprises a suction port to enable air and/or water to be pumped from the suction chamber. It may also have a plurality of attachment points, such as pad eyes, are provided at the upper wall to facilitate lowering/raising the suction anchor to/from the seabed and otherwise handling and transporting it.

The shape and form of the suction anchor is not critical to the invention. However, for reasons of strength and simplicity, it is preferably generally in the form of a cylinder with one closed end. Thus, preferably the outer wall is cylindrical. As such, the suction chamber is preferably annular. Likewise, the internal housing is preferably generally cylindrical and may be co-axial with the outer wall. Although the upper wall may, for example, be domed, a flat upper surface is more convenient and so the upper wall is preferably substantially planar.

In use, the suction anchor described above may typically be provided in combination with a wellhead housing and a wellhead casing, wherein the wellhead housing is rigidly secured within a conductor housing and the conductor housing is rigidly secured within the internal housing, whereby lateral forces applied to the upper part of the wellhead casing are transmitted to the suction anchor.

Furthermore, in use the combination may further comprise a wellhead valve, such as a BOP, mounted above the wellhead housing.

The combination will preferably be installed such that the major portion beneath the seabed and the minor portion projecting therefrom.

It follows that the invention also extends to a method of installing some or all of the components discussed above. Accordingly, viewed from another aspect, the invention provides a method of installing a subsea structure comprising providing a subsea anchor as described in the first-described aspect above, locating the subsea anchor on the sea bed and pumping air and/or water from the suction chamber such that the subsea anchor descends into the sea bed.

The subsea anchor may also have the optional preferred features discussed above. Thus, for example, it is preferably installed in a seabed such that the major portion is beneath the seabed and the minor portion projecting therefrom.

Likewise, the invention may further comprise the step of landing wellhead component(s) in the internal housing. The wellhead components may comprise a wellhead housing (preferably a high pressure wellhead housing) with a wellhead casing depending therefrom.

The method may further comprise subsequent steps where further components are installed at the sea bed. Thus, for example, it may further comprise installing a wellhead valve, such as a BOP, mounted above the wellhead housing.

An embodiment of the invention will be described, by way of example only, and with reference to the following drawings in which.

Figure 1:
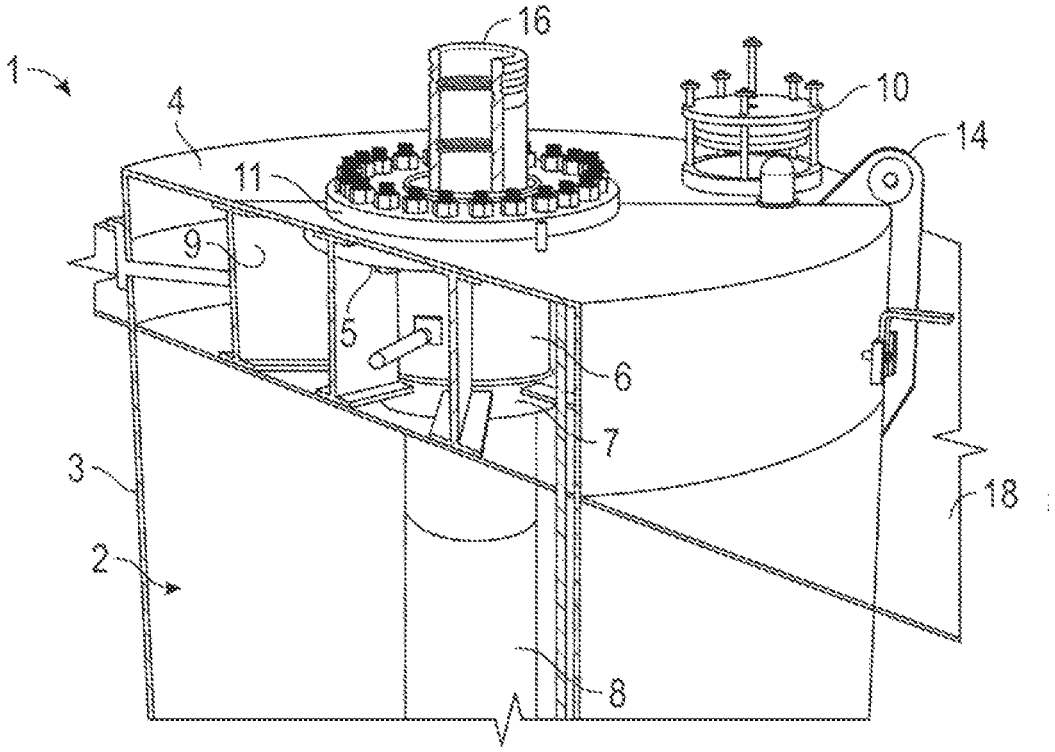
FIG. 1 shows a perspective view of a suction anchor according to an embodiment of the invention in partial cross section.
Figure 2:
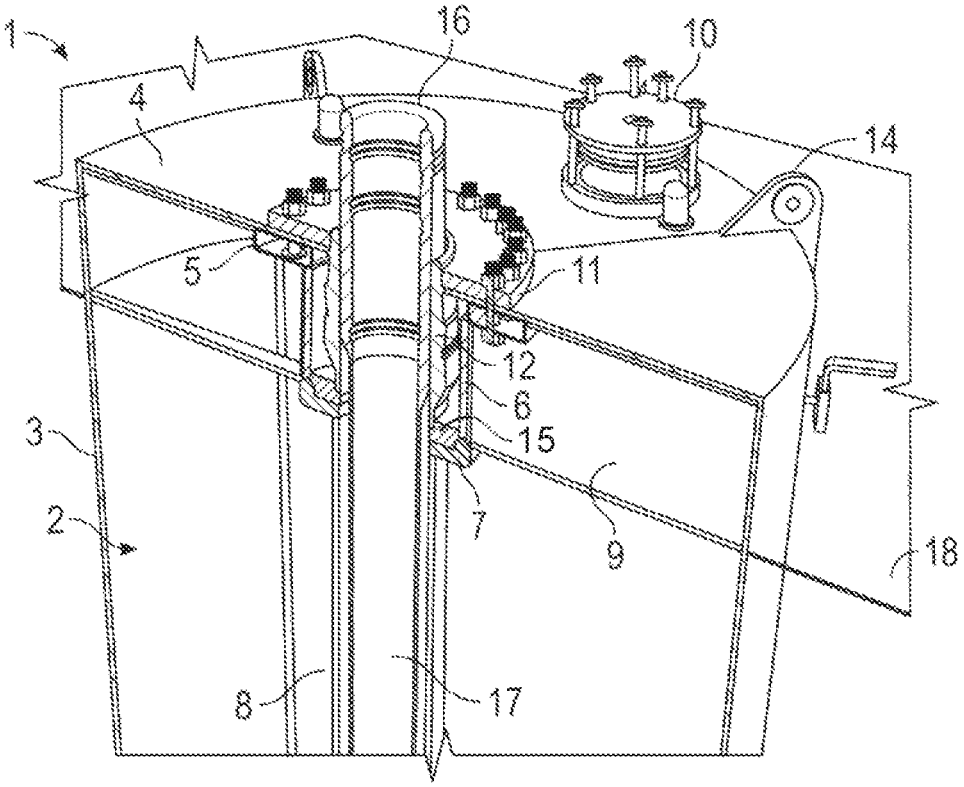
FIG. 2 shows a cross section view of the suction anchor with a cross section through the centre of the suction anchor.

With reference to FIGS. 1 and 2, a suction anchor foundation 1 comprises an annular closed volume forming a suction chamber 2. This closed volume is bounded by a cylindrical outer suction skirt 3 and an annular connection portion 4 in the form of a planar "lid". Together these define the major part of the outer surface of the suction anchor 1.

Within the suction anchor 1 the chamber is further bounded at its upper end by receptacle support ring 5, a cylindrical conductor housing receptacle 6 and inner pipe support ring 7. Beneath these, central/inner pipe of the suction anchor 8 extends downwardly towards the base of the suction anchor. The inner pipe 8 of the suction anchor 1 has the diameter of a conventional conductor (e.g. 30 inches).

These components are all arranged co-axially with the outer suction skirt 3.

Extending radially from the conductor housing receptacle 6 to outer suction skirt 3 are a plurality of I-beam reinforcements 9.

As shown most clearly in FIG. 2, the I-beams 9 extend radially within the internal volume from the outer surface of the conductor housing receptacle 6 to the outer suction skirt 3. The I-beams 9 are each welded at their radially inner end to a conductor housing receptacle 6, inner pipe support ring 7 and receptacle support ring 5, and at their radially outer end to the suction skirt 3 of the suction anchor. Additionally, the I-beams 9 are welded along the length of their top surface to the underside of the annular connection portion 4. As such, these components form a strong and rigid structure.

A number of other components are provided at the upper end of the suction anchor 1.

One of these is pump port 10 for connection via a pipe to a vacuum pump for removing air and water from the suction chamber 2 as will be described below.

In addition, a number of pad eyes 14 are located around the circumference of the top annular connection portion. These pad eyes may be used to help lift and support the suction anchor 1 during installation and removal.

At the centre of the annular connection portion 4 is provided a clamp ring 11. This surrounds the central opening in the annular connection portion and co-operates with receptacle support ring, to which it is bolted, to secure a conductor housing 12 within the conductor housing receptacle 6. The clamp ring 11 acts against a protrusion towards the upper end of the conductor housing 12. The lower end of the conductor housing 12 rests on mount ring 15, which in turn is supported by an annular shoulder of support ring 7. This arrangement may most clearly be seen from FIG. 3.

Thus, the conductor housing 12 is clamped into the conductor housing receptacle 6 at the upper end thereof by clamp ring 11, compressing the conductor housing 12 against the mount ring 15 on the inner pipe support ring 7. As a result, conductor housing 12 is securely and rigidly attached to the conductor housing receptacle 6 and in turn to I-beams 9 etc.

The mount ring 15 can act as an adapter to allow the suction anchor 1 to be used with different sizes and geometry of conductor housings 12 that may be provided by different suppliers.

Figure 3:
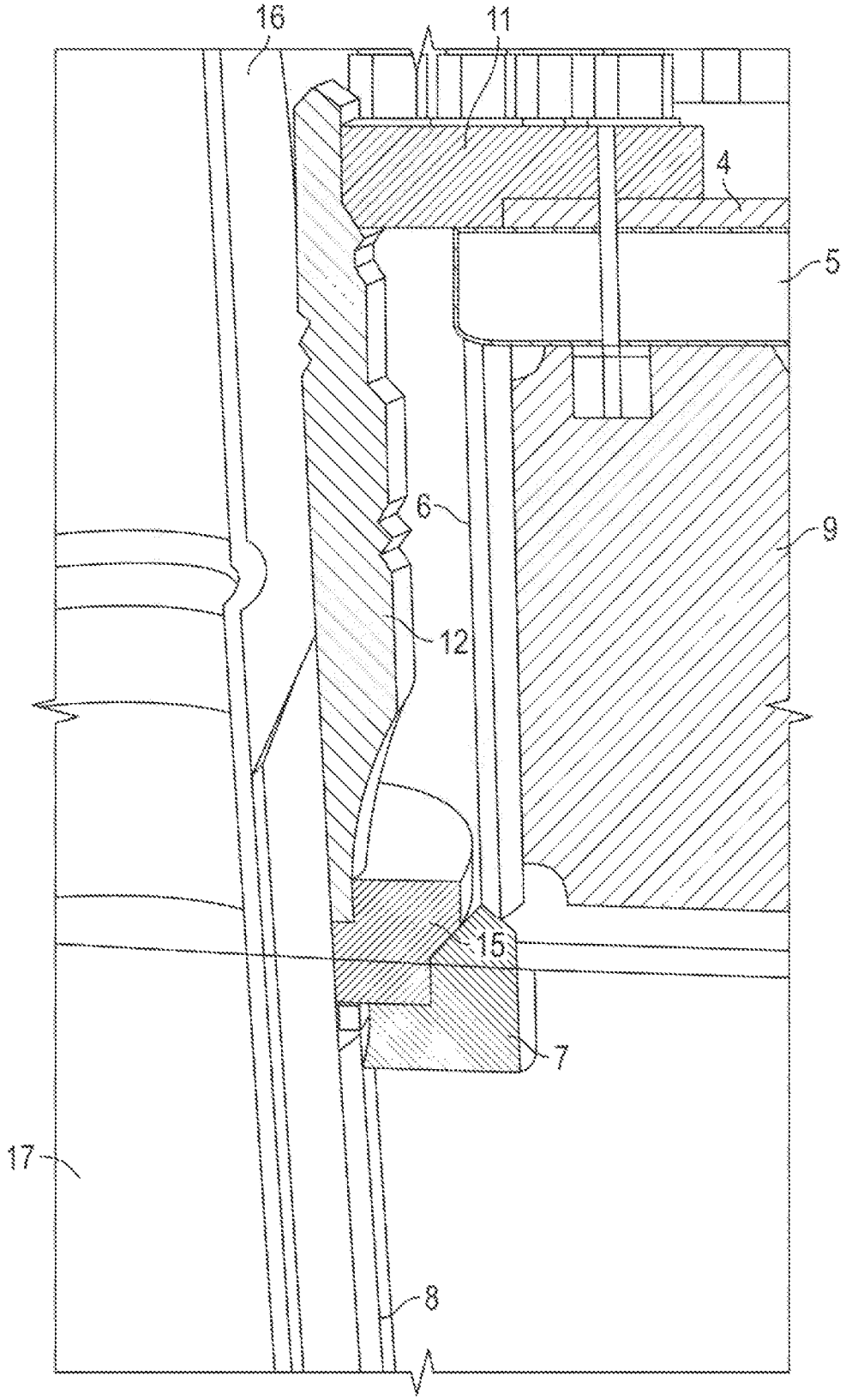
FIG. 3 shows an enlargement of a portion of the cross section of FIG. 2.

Note also from FIG. 3 that the conductor housing receptacle 6 is fixed at its top end to the annular connection portion 4 of the suction anchor via receptacle support ring 5. It may also be seen that, at the bottom end of the conductor housing receptacle 6, inner pipe 8 is hung from inner pipe support ring 7.

Extending though the conductor housing 12 is high pressure wellhead housing 16 that supports a wellhead casing 17 extending through the middle of the suction anchor as shown most clearly in FIG. 2. The high pressure wellhead housing 12 is the component onto which wellhead valves such as a BOP are mounted in use.

When the suction anchor 1 is to be installed, it is lowered to the sea bed 18 by means of cables attached to pad eyes 14. At this stage, it comprises the conductor housing 12, but not the wellhead 16 or wellhead casing 17.

Once placed on the sea bed 18, the suction anchor 1 will generally self-penetrate a certain depth into the sea bed (the exact depth depending on factors such as the weight of the suction anchor and the geology of the sea bed) such that the inner pipe 8 and outer suction skirt 3 penetrate into the seabed 18 to form the closed sealed volume 2 within which the pressure can be adjusted. The pressure is reduced by connecting the pump port 10 (shown in expanded form in FIGS. 1 and 2) in the top annular connection plate 4 to a pump (not shown). The pump removes air and/or water from inside the internal annular volume 2 to reduce the pressure. The suction anchor may thus be sucked into the seabed 18 until radially extending I-beams 9 within the internal annular volume contact the seabed 18 as shown in FIGS. 1 and 2. As the pressure is reduced in the internal annular volume of the suction anchor, the I-beams serve to reinforce the annular connection portion 4 against implosion or collapse.

Subsequently, the high pressure wellhead housing 16 and wellhead casing 17 are installed. The former is landed in the conductor housing to provide the configuration shown in the figures. It supports wellhead casing 17, which forms an extension thereof. Thus, these components extend downwardly through the inner pipe 8 of the suction anchor 1. It will be noted that, contrary to a typical well, the conductor housing 12 does not support a conductor casing. This is because the conductor casing is not required due to the presence of the inner pipe 8, which performs a corresponding function.

It will be appreciated that the conductor casing 12 and associated components serve to secure the wellhead casing 17 securely and rigidly relative to the conductor housing receptacle, I-beams, etc. In particular, the mount ring 15 (at the top) and the clamp ring 11 (at the bottom) each provide a load transmitting connection point between the conductor housing 12 (and hence a wellhead secured within it) and the suction anchor. As such, lateral forces or bending/rotational forces about a horizontal axis applied to the conductor housing and wellhead may be resisted because there is a load path from the wellhead to the seabed.

Prior to use, wellhead valves such as a blowout preventer (BOP—not shown) are connected to and mounted on top of the high pressure wellhead 16 in the known manner. As is well known in the art, these components are relatively massive and tend to apply significant lateral forces to the upper part of the wellhead—i.e. they apply a bending moment to it.

Because the I-beams 9 are secured to the conductor housing receptacle 6 as well as to the annular connection portion 4 (the lid of the suction anchor), in addition to reinforcing the suction chamber, they serve the important function of providing a load path through which loads exerted on the wellhead can be transferred into the suction anchor before ultimately being transferred into the seabed. Accordingly, the suction anchor is able to protect the wellhead 16 from damage that might be caused by horizontal components of force caused by the BOP or other components connected above it.

The invention claimed is:

1. A suction anchor comprising:

a suction chamber bounded by: (i) a circumferential outer wall, (ii) an upper wall having a central opening, and (iii) a wall of an internal housing;

the internal housing defining a passage in communication with the central opening for receiving wellhead components that may be secured to the suction anchor;

the suction chamber having a minor upper portion and a major lower portion, and the minor upper portion is smaller than the major lower portion;

the minor upper portion comprising internal reinforcing members extending along the inside of the upper wall from the outer walls to the internal housing, wherein the internal reinforcing members are located only in the minor upper portion and do not extend into the major lower portion;

the major lower portion being adapted to be embedded in a seabed and the minor upper portion being adapted to project from the seabed when the anchor is installed, wherein the bottoms of the internal reinforcing members lie on an upper surface of the seabed when the suction anchor is fully installed;

wherein the internal reinforcing members serve both to reinforce the upper wall of the suction chamber against collapse and to rigidly support the internal housing such that it may resist forces applied to it arising from bending moments applied to a wellhead component received and secured therein; and wherein the minor upper portion is bounded at an upper end by a planar lid and support ring, and an inner pipe support ring is provided at a lower end of the minor upper portion.

2. The suction anchor as claimed in claim 1, wherein the internal housing is a conductor housing receptacle adapted to receive a conductor housing.

3. The suction anchor as claimed in claim 2, wherein the conductor housing receptacle further comprises a conductor housing located therein and rigidly secured thereto, the conductor housing being adapted to receive a wellhead component.

4. The suction anchor as claimed in claim 3, wherein the conductor housing is clamped into the conductor housing receptacle.

5. The suction anchor as claimed in claim 1, wherein the internal reinforcing members extend radially from the wall of the internal housing to the outer wall, and wherein the internal reinforcing members are I-beams.

6. The suction anchor as claimed in claim 1, further comprising a central pipe depending from the internal housing and serving to bound the inner part of the major portion of the suction chamber.

7. The suction anchor as claimed in claim 6, wherein the central pipe is adapted to receive a well casing depending from a wellhead secured in the internal housing.

8. The suction anchor as claimed in claim 1, further comprising a suction port to enable air and/or water to be pumped from the suction chamber.

9. The suction anchor as claimed in claim 1, wherein a plurality of attachment points are provided at the upper wall.

10. The suction anchor as claimed in claim 1, wherein the upper wall is substantially planar, and the bottoms of the internal reinforcing members are parallel with the upper wall.

11. The suction anchor as claimed in claim 1 in combination with a wellhead housing and a wellhead casing, wherein the wellhead housing is rigidly secured within a conductor housing and the conductor housing is rigidly secured within the internal housing, whereby lateral forces applied to the upper part of the wellhead casing are transmitted to the suction anchor.

12. The combination of claim 11, further comprising a wellhead valve mounted above the wellhead housing.

13. The combination of claim 11, wherein the suction anchor is installed in a seabed with the major portion beneath the seabed and the minor portion projecting therefrom.

14. The suction anchor as claimed in claim 1, wherein the internal housing is a conductor housing receptacle adapted to receive a conductor housing.

15. A method of installing a subsea structure comprising providing a subsea anchor as claimed in claim 1, locating the subsea anchor on the sea bed and pumping air and/or water from the suction chamber such that the subsea anchor descends into the seabed.

16. The method as claimed in claim 15, wherein the suction anchor is installed in a seabed such that the major portion is beneath the seabed and the minor portion is projecting therefrom.

17. The method as claimed in claim 15, further comprising the step of landing at least one wellhead component in the internal housing.

18. The method as claimed in claim 17, wherein the at least one wellhead component comprises a wellhead housing with a wellhead casing depending therefrom.

19. The method as claimed in claim 18, further comprising installing a wellhead valve mounted above the wellhead housing.

* * * * *